US007762097B2

(12) United States Patent
Jeong et al.

(10) Patent No.: US 7,762,097 B2
(45) Date of Patent: Jul. 27, 2010

(54) REFRIGERATOR HAVING AN ICE MAKER AND ICE DISPENSER

(75) Inventors: Kyung Han Jeong, Seoul (KR); In Chul Jeong, Seoul (KR); Myung Ryul Lee, Seongnam-si (KR)

(73) Assignee: LG Electronics Inc., Seoul (KR)

( * ) Notice: Subject to any disclaimer, the term of this patent is extended or adjusted under 35 U.S.C. 154(b) by 405 days.

(21) Appl. No.: 11/717,175

(22) Filed: Mar. 13, 2007

(65) Prior Publication Data

US 2007/0214825 A1 Sep. 20, 2007

(30) Foreign Application Priority Data

Mar. 14, 2006 (KR) ..... 10-2006-0023664

(51) Int. Cl.
*F25C 1/22* (2006.01)
*A23G 9/00* (2006.01)

(52) U.S. Cl. ..... 62/340; 62/343

(58) Field of Classification Search ..... 62/320, 62/340, 326, 343, 344, 345, 354, 381; 222/146.6, 222/240, 241, 412, 413
See application file for complete search history.

(56) References Cited

U.S. PATENT DOCUMENTS 2,641,984 A * 6/1953 Hall ..... 172/549
2,919,632 A * 1/1960 Smith et al. ..... 409/317
3,268,118 A * 8/1966 Hoenisch et al. ..... 222/108
5,056,688 A * 10/1991 Goetz et al. ..... 222/146.6
5,911,749 A 6/1999 Sugie
6,010,037 A * 1/2000 Thompson ..... 222/240
2005/0044874 A1 * 3/2005 Lee et al. ..... 62/344

FOREIGN PATENT DOCUMENTS

| | | |
|---|---|---|
| CN | 1063352 | 8/1992 |
| CN | 1598451 | 3/2005 |
| CN | 1598453 | 3/2005 |
| CN | 2736715 | 10/2005 |
| JP | 2003-240395 | 8/2003 |

* cited by examiner

*Primary Examiner*—Frantz F. Jules
*Assistant Examiner*—Emmanuel Duke
(74) *Attorney, Agent, or Firm*—KED & Associates, LLP

(57) ABSTRACT

An ice maker for a refrigerator includes a first shaft rotatably fastened to an inside of an ice bank, a second shaft fastened to an end of the first shaft and rotated by a driving motor, and a plurality of blades formed along a longitudinal direction of the second shaft. The blades are spaced apart a predetermined distance along the second shaft and have a spiral surface which acts to push ice as the second shaft rotates. The first shaft may be formed of a material such as steel, which has good torsional elasticity. The second shaft and the blades may be formed as one molded piece.

21 Claims, 7 Drawing Sheets

REFRIGERATOR HAVING AN ICE MAKER AND ICE DISPENSER

This application claims the benefit of Korean Patent Application No. 10-2006-0023664, filed on Mar. 14, 2006, which is hereby incorporated by reference as if fully set forth herein.

BACKGROUND

1. Field

The present invention relates to a refrigerator, and more particularly, to an ice maker and ice dispenser for a refrigerator.

2. Background

Refrigerators typically include a freezing compartment and a refrigerating compartment. The refrigerating compartment stores food such as vegetables and beverages at approximately 3° C.~4° C., and the freezing compartment stores food items at temperatures below freezing. Recently, various functions have been added to refrigerators so that a user may use the refrigerator more conveniently. An ice maker and ice dispenser, which will be described, is one of the various functions.

Referring to FIGS. 1 to 3, a conventional ice maker for a refrigerator will be described. FIG. 1 is a front view illustrating a conventional refrigerator. FIG. 2 is a top view illustrating an upper portion of an ice bank of the refrigerator shown in FIG. 1. FIG. 3 is an exploded perspective view illustrating components provided within the ice bank of the refrigerator of FIG. 1.

Referring to FIG. 1, the conventional refrigerator includes a freezing compartment and a refrigerating compartment, and doors are coupled to the fronts of the refrigerating and freezing compartments. A control panel (not shown) may be provided on an outer surface of one or both of the doors for allowing a user to select predetermined functions of the refrigerator.

An ice maker 10 is installed in the freezing compartment to make and discharge ice. An ice chute 2 is provided in the door 1, and is positioned at lower portion of the ice bank 20 when the door 1 is closed. A dispenser (not shown) is connected to a lower portion of the ice chute 2.

As shown in FIG. 1, an upper surface of the ice bank 20 is open so that is can receive ice, which drops from the ice maker 10. A lower surface of the ice bank 20 has an ice outlet formed therein. The ice outlet corresponds to the ice chute 2.

Also, as shown in FIG. 1, the ice bank 20 includes an ice transmission part, a motor 23, a crusher 30 and an ice discharger 40. The ice transmission part includes an auger 22 having some portion thereof formed in a spiral shape. An end of the auger 22 extends to the ice crusher 30 to form a shaft, and a helix 24 is mounted at an end of the auger 22. The helix 24 pushes ice toward the crusher 30.

A helix member 26 is provided in an entrance of the helix 24 to adjust ice drawn into the helix 24 as much as regularly needed. A ring 28 is connected to the opposite end of the auger 22. The ring 28 interfaces with an output shaft of the motor 23 to transmit the driving force of the motor 23 to the auger 22.

When the motor rotates, the ice transmission part rotates such that ice is moved into the helix 24 by the spiral portion of the auger 22. Hence, the ice is discharged to the dispenser or transmitted to the crusher 30. The crusher 30 for crushing ice includes a housing 31, fixed blades 32 and movable blades 33.

However, the ice maker of the conventional refrigerator according to the related art has following problems. First, since the auger of the ice transmission part is made of stainless steel, which has high strength and rigidity, forming the auger in a spiral shape can be difficult, which increases the manufacturing cost In addition, because the ice transmission part includes various components such as the auger, the helix, the helix member and the ring, assembling all the components of an ice maker of the conventional refrigerator requires many process steps. This also increases the cost of production, and makes the assembly process slower.

Also, the conventional ice transmission part with the above-described configuration tends to have a poor capability to prevent ice from being stuck together within the ice bank. In other words, once ice cubes become stuck together, the auger is unlikely to break the cubes back apart.

BRIEF DESCRIPTION OF THE DRAWINGS

The embodiments will be described in detail with reference to the following drawings in which like reference numerals refer to like elements, and wherein.

DETAILED DESCRIPTION

Figure 1:
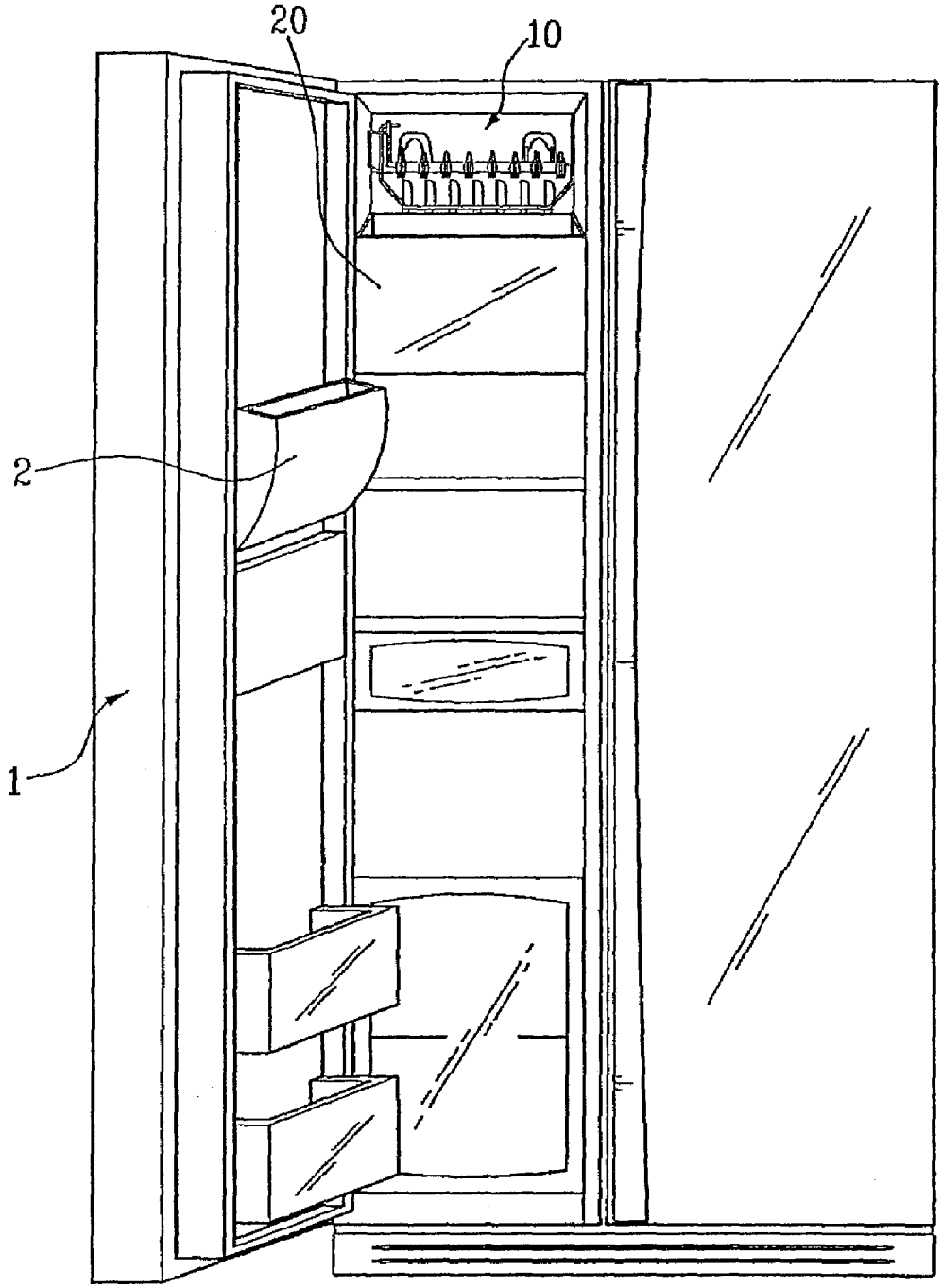
FIG. 1 PRIOR ART
FIG. 1 is a front view illustrating a conventional refrigerator.
Figure 2:
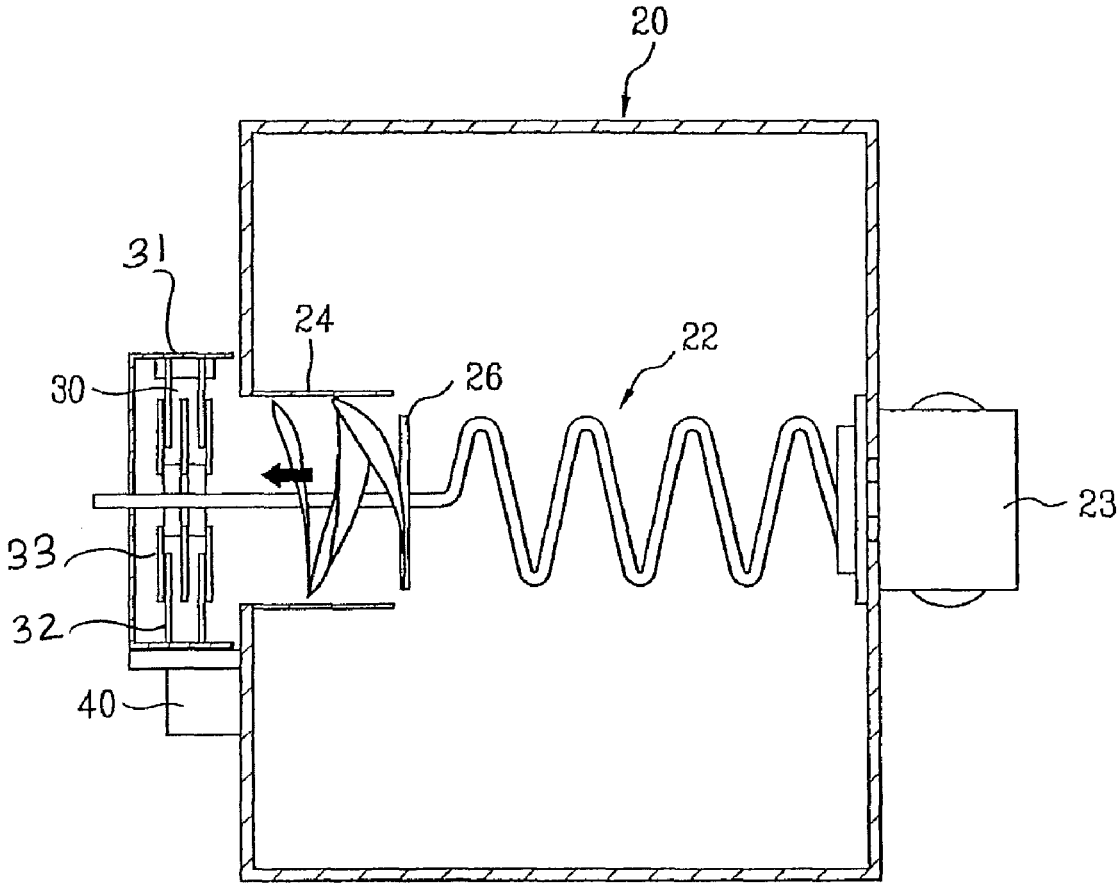
FIG. 2 PRIOR ART
FIG. 2 is a top view illustrating an upper portion of an ice bank of the refrigerator shown in FIG. 1.
Figure 3:
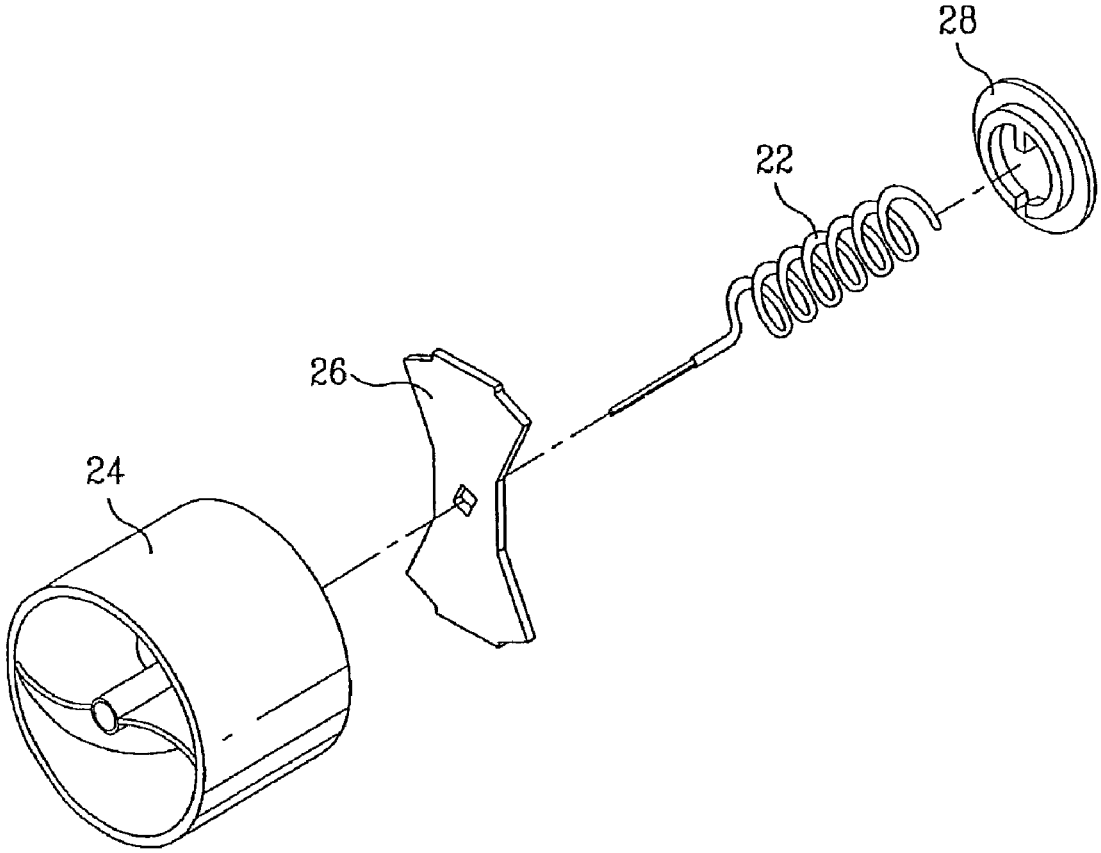
FIG. 3 PRIOR ART
FIG. 3 is an exploded perspective view illustrating components provided within the ice bank of FIG. 1.

Reference will now be made in detail to preferred embodiments, examples of which are illustrated in the accompanying drawings. Wherever possible, the same reference numbers will be used throughout the drawings to refer to the same or like parts.

A first embodiment, as shown in FIGS. 4-7, includes an ice bank 120, a driving device 123 and an ice transmission device 150. An ice making part (not shown) would be located over the ice bank 120, and would freezes ice and delivers the ice to the ice bank 120. The ice making part is well-known, and therefore a detailed description thereof is omitted.

The ice bank 120 has an ice discharger (not shown) formed in a side thereof to discharge ice outside of the ice bank 120. Also, the ice transmission device 150 is provided to transmit the ice to the ice discharger (not shown) so that a user may extract the ice from the ice bank 120.

A crusher 130 for crushing ice into small pieces and a damper 140 for discharging full ice cubes, in other words, ice that has not been crushed, may be fastened to the ice discharger (not shown).

Preferably, the ice transmission device 150 is installed adjacent to a bottom of the ice bank 120. The ice transmission device 150 includes a first shaft 152 rotatably fastened to an inside of the ice bank 120. A second shaft 154 is fastened to an end of first shaft 152 and one or more blades 156 are formed on the second shaft 154. Preferably, the blades 156 are formed as one body with the second shaft 154. The second shaft 154 may be formed as one body with the first shaft 152 by insert injection molding the second shaft 154 and the blades 156 around an end of the first shaft 152.

A surface of the blades 156 which push ice is called a pressure surface 156*a*. One or more reinforcing ribs 158 may be formed on a side of the blades opposite the pressure surface 156*a* to reinforce rigidity of the blades 156.

Figure 6:
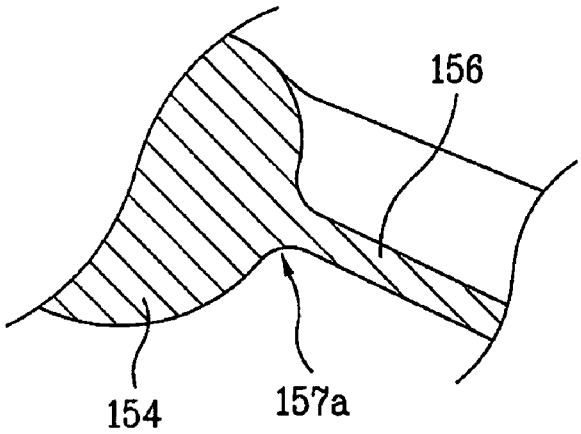
FIG. 6 is a sectional view taken along section line I-I of FIG. 5 illustrating how a blade is attached to a rotating shaft.

As shown in FIG. 6, if a portion of the blade 156 immediately adjacent the second shaft 154 is angularly formed, stress may be concentrated on the bordering portion. To avoid the stress concentration, it is preferred that the bordering portion between the blade 156 and the second shaft 154 has a curved joint 157*a*.

Figure 7:
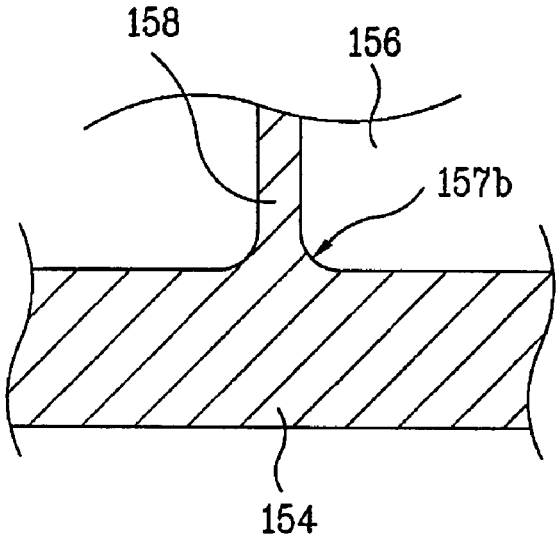
FIG. 7 is a sectional view Taken along section line II-II line of FIG. 5 illustrating a reinforcing structure for the blades.

As shown in FIG. 7, the reinforcing ribs 158 are formed on the side of the blades opposite the pressure surface 156*a*, and they protrude from both the blades and an outer circumferential surface of the second shaft 154. Preferably, bordering portions between the ribs 158 and the second shaft 154 also have curved joints 157*b*.

The longer ice is stored in the ice bank 120, the more the ice cubes tend to stick to each other. This occurs because the surface of ice is melted and refrozen again. The larger the height and cross-section of the blades 156, the better the blades will be at separating ice cubes that are stuck together. Of course, the rotation force of the driving device 123 and the rigidity of the blades 156 also play a role. Those skilled in the art can take these factors into account in determining the optimal height and section of the blade 156.

Preferably, the first shaft 152 is made of material having good torsional elasticity. In this first embodiment, the first shaft 152 is made of stainless steel. In other embodiments, the first shaft 152 could be made of other metals, or from other types of materials having the required strength. An end of the first shaft 152 may be fastened to the ice crusher 130.

The second shaft 154 is preferably, made of a synthetic material for insert-molding convenience. In preferred embodiments, for ease of manufacture, the blades 156 formed as one body with the second shaft 154. Thus, it is preferred that the blades 156 be made of the same material as the second shaft 154.

The ice crusher 130 crushes ice and includes one or more fixed blades (not shown) and one or more rotating blades (not shown). The rotary blades would rotate in accordance with rotation of the first shaft 152. Ice cubes would be caught between the fixed blades (not shown) and the rotating blades (not shown) to be crushed.

A damper 140 may be provided at a side of the crusher 130 so that ice cubes can be discharged outside before being crushed by the crusher 130.

Preferably, the blade 156 which is adjacent to the crusher 130 is provided very closely adjacent to the crusher 130. The more closely adjacent the blade 156 is to the crusher 130, the more tightly ice cubes can be forced into crusher 130.

A transmitting part 159 may be formed at an end of the second shaft 154, and may be fastened to the driving device 123. The transmitting part 159 sends the rotation force of the driving device 123 to the second shaft 154. The transmitting part 159 may be also molded as one body with the second shaft 154. The driving device 123 rotates the ice transmission device 150, which includes the first shaft 152, the second shaft 154 and the blades 156. Commonly, the driving device 123 includes a motor, a gear and a controller. Because these features are well known in the art, a detailed description is omitted.

Figure 4:
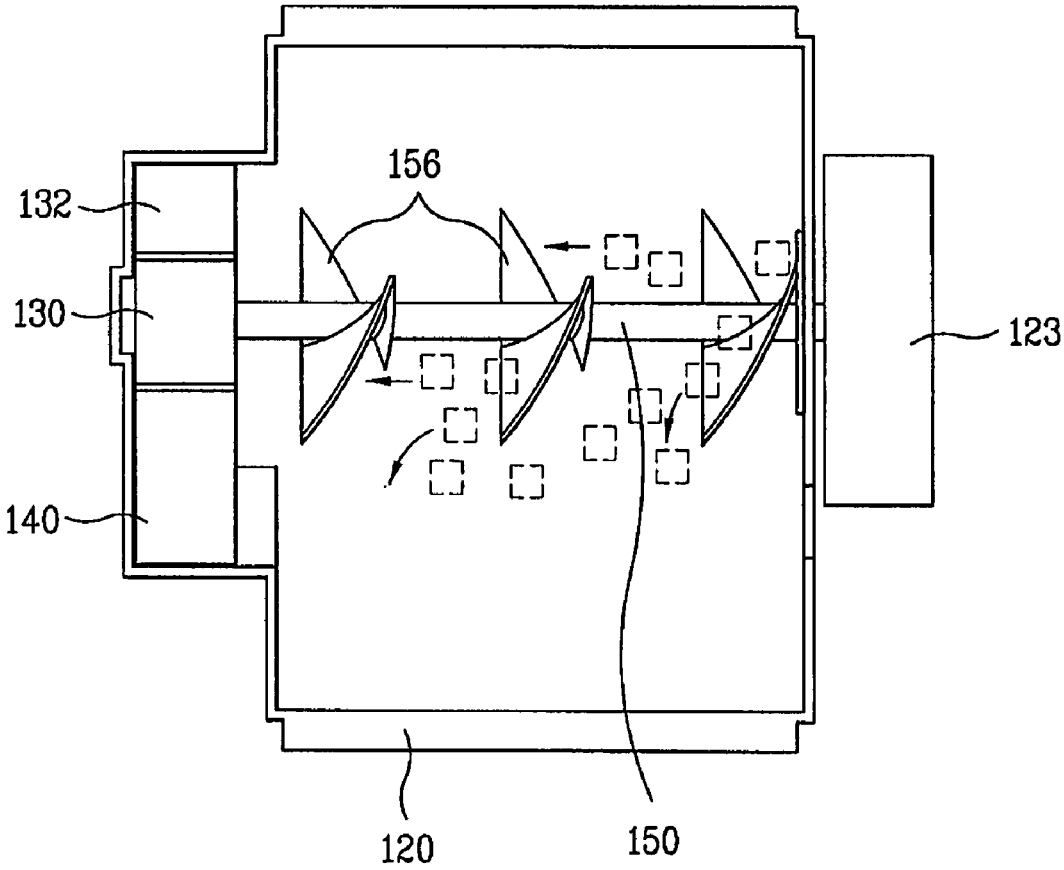
FIG. 4 is a top view illustrating a first embodiment of an ice bank.

Operation of the ice maker according to the embodiment described above will be described as follows. As shown in FIG. 4, the driving device 123 rotates, and the transmitting part 159 receives the driving force of the driving device 123 to rotate the second shaft 154 of the ice transmission device 150. As the second shaft 154 rotates, the first shaft 152 and the blades 156 rotate. Since the blades 156 are formed in a spiral shape, the pressure surfaces 156*a* of the blades 156 push ice toward the crusher 130 and the damper 140.

The rotating blades sweep across a greater area than one of the spiral augers of a prior art device. As a result, the ice pushing efficiency may be enhanced and the ice cubes may be prevented from sticking together more efficiently compared to the related art devices where the ice cubes are pushed by an auger 22. Also, because the reinforcing ribs 158 are formed on the blades 156, the rigidity of the blades 156 may be enhanced enough to prevent damage thereof.

As shown in FIGS. 6 and 7, the bordering portions between the blades 156 and the second shaft 154, and the bordering portions between the ribs 158 and the second shaft 154 have curved joints 157*a* and 157*b*. Thereby, stress concentration may be minimized to lessen the possibility of damage to the ice transmission device.

Figure 5:
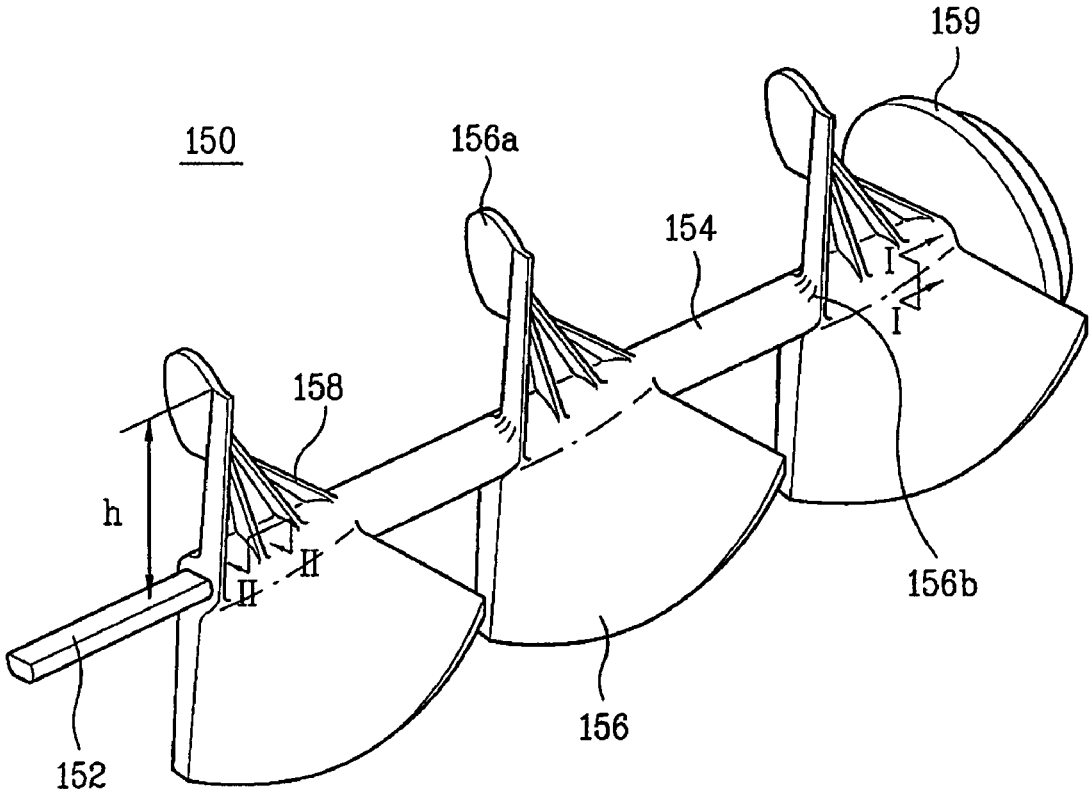
FIG. 5 is a perspective view illustrating an ice transmission device installed within the ice bank of FIG. 4.

In preferred embodiments, such as the one shown in FIGS. 4-6, the blades 156 are not formed on the second shaft 154 continuously. Instead, they are spaced apart by a predetermined distance. As a result, some of the ice pushed by the rear blade 156 may be pushed outside between the blades 156 and mixed with ice within the ice bank 120. Thus, ice may be mixed more actively as compared to prior art devices, which also helps to prevent ice from sticking together. Also, ice cubes that have become stuck together may be separated due to the mixture of ice cubes, thereby resulting in less ice being stuck together.

As the blades 156 rotate, ice is transmitted to the crusher 130 by the ice transmission device 150. Ice within the crusher 130 is crushed by the rotating blades (not shown) and the fixed blades (not shown). When the ice is caught and crushed between the rotating blades (not shown) and the fixed blades (not shown), torsion is applied to the first and second shafts 152 and 154. Since the first shaft 152 fastened to the crusher 130 is made of a material having elasticity against torsion, the first shaft 152 may absorb a portion of the torsion applied to the second shaft 154, thereby reducing the possibility of damage to the ice transmission device.

Because the transmitting part 159 and the blades 156 are formed as one body with the second shaft 154 by insert-molding, work effort of the final assembly process may be lessened. Further, the second shaft may be insert injection molded around the first shaft, further reducing the assembly effort. This reduces the assembly time and cost, and improves productivity.

Because the first shaft 152 is made of metal and the second shaft 154 is made of a synthetic material, the length of the metallic portion of the overall device can be lessened relative to prior art devices having a metallic auger. This further reduces production costs.

Figure 8:
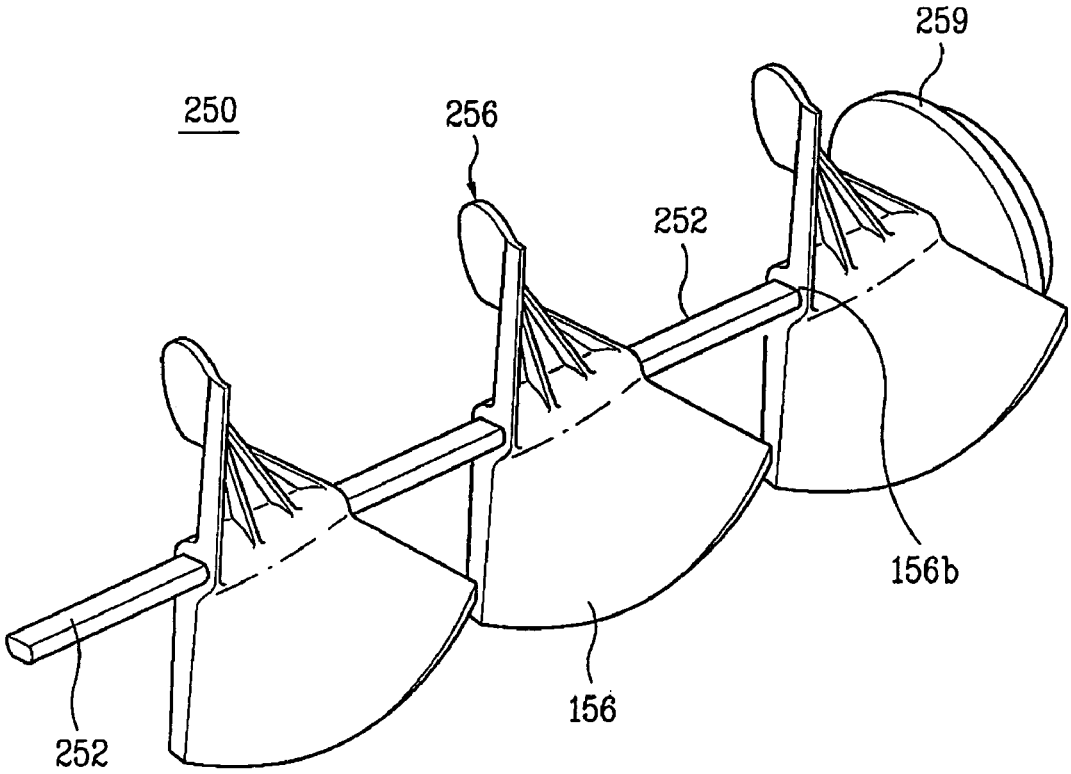
FIG. 8 is a perspective view illustrating an ice transmission device of another embodiment.
Figure 9:
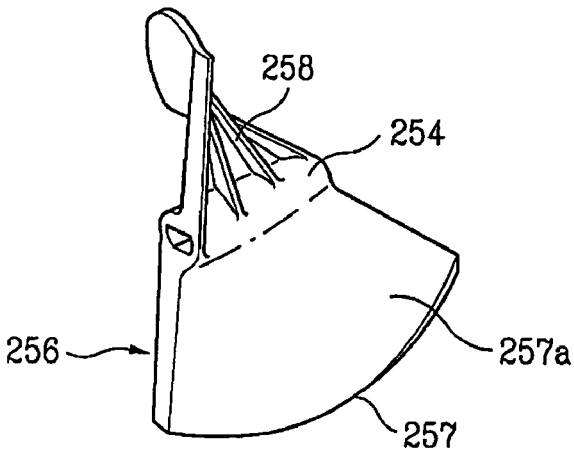
FIG. 9 is a perspective view illustrating one of the blades of the ice transmission device of FIG. 8.

An ice maker according to another embodiment will now be described with reference to FIGS. 8 and 9. This embodiment also includes an ice bank 120, and a driving device 123 similar to the ones described above. A shaft 252 is rotated by the driving device and a plurality of ice transmission members 256 are formed on the shaft.

Similar to the embodiment described above, a first end of the shaft 252 would be connected with a driving device 123, and a second end thereof would be connected with an ice crusher 130. Preferably, the shaft 252 is made of material having elasticity against torsion, for example, a metal such as stainless steel.

At least one ice transmission member 256 is provided on the shaft 252. The ice transmission member 256 has a spiral shape. The ice transmission members 256 formed on the shaft 252 would push ice toward a predetermined portion in accordance with the rotation of the shaft 252. Preferably, multiple separate ice transmission members 256 would be formed on the shaft 252.

The ice transmission members 256 are preferably made of synthetic material. As shown in FIG. 9, each ice transmission member 256 includes a fixing part 254 fastened to the shaft 252 and a blade 257 expanded outwardly from the fixing part 254 to form a spiral surface to push ice in accordance with the rotation of the shaft 252. A bordering portion between the blade 257 and the fixing part 254 may have a rounded joint shape to avoid stress concentration thereon. Preferably, the ice transmission member 256 is formed as one body with the shaft 252 by insert injection molding the ice transmission members 256 around the shaft 252.

Like the embodiment described before, a surface of the blade 257 which pushes ice is called a pressure surface 257*a*. Also, a plurality of reinforcing ribs 258 may be formed on a side of the blade opposite pressure surface 257*a* to reinforce rigidity of the blade 257. The reinforcing ribs 258 protrude from an outer end of the blade 257, and from the fixing part 254. A bordering portion between the reinforcing ribs 258 and the fixing part 254 may also have a rounded joint shape to prevent stress concentration thereon.

Similar to the first embodiment described above, the second embodiment may include a transmitting part 259 fastened to the driving device 123. The transmitting part 259 would be provided at an end of the shaft 252 to transmit the driving force of the driving device 123 to the shaft 252. Preferably, the transmitting part 259 is also insert injection molded around the end of shaft 252 at the same time the blades are formed.

The other components of an ice maker according to the second embodiment are the same as those of the ice maker according to the first embodiment. Therefore, a detailed description thereof will be omitted.

Although an ice maker according to the above described embodiments may be provided in a refrigerator, one or more aspects of the described ice makers could be applied to all kinds of devices which transmit ice.

An ice maker as described above has many advantages compared to the prior art. First, because the blades can be formed as one body by insert-molding, work effort in the final assembly process may be reduced and assembly may be simple. This enhances overall productivity.

Next, instead of using a metal wire auger to move the ice cubes, the pressure surfaces of the blades pushes the ice cubes. Thus, ice may be mixed more smoothly within the ice bank, and the movement of the blades may prevent ice cubes from sticking together. Ice cubes which have become stuck together may be mixed and separated. Therefore, an ice maker according to the above-described embodiments has another advantageous effect of reducing or preventing ice cubes from being stuck together.

Next, in the first embodiment, since the first shaft is made of metal and the second shaft made of synthetic resin, the length of a shaft using expensive stainless steel may be minimized. This reduces the cost of the ice maker.

Also, because at least some of the ice transmission member of the ice transmission device that transmits the driving force of the motor is made of material which can elastically absorb torsion, the blades may be prevented from being damaged.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice dispenser, comprising: an ice bank having an outlet through which ice is dispensed; a first shaft that is rotatably mounted in the ice bank; a second shaft that is rotatably positioned within the ice bank and that is coupled to the first shaft; a driver that is coupled to the second shaft and that selective rotates the second shaft; and a plurality of blades mounted on the second shaft, each of the plurality of blades having a spiral surface which acts to push ice along a longitudinal direction of the second shaft as the second shaft is rotated, wherein each of the plurality of blades extend radially outward from the shaft and are arranged along the length of the second shaft and spaced apart from one another by a predetermined interval, and wherein at least one reinforcing rib is formed in the at least one blade each of the plurality of blades.

2. The ice dispenser of claim 1, wherein second shaft is formed of a molded material, and wherein an end of the second shaft is insert injection molded around an end of the first shaft to couple the second shaft to the first shaft.

3. The ice dispenser of claim 1, wherein the second shaft and the plurality of blades are formed of a molded material, and wherein the plurality of blades is formed as one molded piece with the second shaft.

4. The ice dispenser of claim 3, wherein border areas between the second shaft and the plurality of blades have rounded filleted edges.

5. The ice dispenser of claim 3, wherein the first shaft is made of a material which has good torsional elasticity.

6. The ice dispenser of claim 5, further comprising an ice crusher mounted on the ice bank adjacent the outlet, wherein the first shaft is coupled to the ice crusher.

7. The ice dispenser of claim 3, further comprising a transmitting part that is coupled to an end of the second shaft and to the driver, wherein the transmitting part transmits a driving force from the driver to the second shaft.

8. The ice dispenser of claim 3, further comprising an ice maker that delivers ice to the ice bank.

9. The ice dispenser of claim 1, wherein a first side of the plurality of blades acts to push ice along a longitudinal direction of the second shaft as the second shaft rotates, and wherein the at least one reinforcing rib is formed on a second side opposite the first side of the plurality of blades.

10. The ice dispenser of claim 9, wherein the at least one reinforcing rib comprises a plurality of reinforcing ribs.

11. A refrigerator comprising the ice dispenser of claim 1.

12. An ice dispenser, comprising: an ice bank having an outlet for dispensing ice; a shaft that is rotatably mounted in the ice bank; and a plurality of ice transmission members that are mounted along the length of the shaft and spaced apart from each other at predetermined intervals along the length of the shaft, wherein each ice transmission member comprises: a blade and a spiral surface that acts and extends radially outward from the shaft so as to move ice along a longitudinal direction of the shaft as the shaft rotates; and wherein a first side of the blade of each of the ice transmission members pushes ice along the longitudinal direction of the shaft as the shaft rotates, and wherein at least one reinforcing rib is formed on a second side opposite the first side of the blade.

13. The ice dispenser of claim 12, wherein each of the ice transmission members are formed of a molded material.

14. The ice dispenser of claim 13, wherein the plurality of ice transmission members are molded on an exterior of the shaft.

15. The ice dispenser of claim 14, further comprising a driver that is coupled to the shaft and that selectively rotates the shaft.

16. The ice dispenser of claim 15, further comprising a transmitting part that is coupled to an end of the shaft and to the driver, wherein the transmitting part transmits a driving force from the driver to the shaft, and wherein the transmitting part is also formed of a molded material.

17. The ice dispenser of claim 14, further comprising an ice maker that delivers ice to the ice bank.

18. The ice dispenser of claim 14, wherein each of the ice transmission member further comprises: a fixing part that couples the ice transmission member to the shaft, wherein the blade extends outward from the fixing part to form the spiral surface.

19. The ice dispenser of claim 18, wherein a border portion between the fixing part and the blade of each of the ice transmission members comprises a curved joint.

20. The ice dispenser of claim 18, wherein the at least one reinforcing rib extends from the fixing part to the blade.

21. A refrigerator comprising the ice dispenser of claim 12.

* * * * *